United States Patent [19]

Umemura et al.

[11] Patent Number: 4,692,654

[45] Date of Patent: Sep. 8, 1987

[54] ULTRASONIC TRANSDUCER OF MONOLITHIC ARRAY TYPE

[75] Inventors: Shinichiro Umemura, Hachioji; Hiroshi Takeuchi, Matsudo; Kageyoshi Katakura, Tokyo, all of Japan

[73] Assignees: Hitachi, Ltd.; Hitachi Medical Corporation, both of Tokyo, Japan

[21] Appl. No.: 793,323

[22] Filed: Oct. 31, 1985

[30] Foreign Application Priority Data

Nov. 2, 1984 [JP] Japan ..... 59-230224

[51] Int. Cl.[4] ..... H01L 41/08

[52] U.S. Cl. ..... 310/334; 310/327; 310/359; 310/366; 310/367

[58] Field of Search ..... 310/334–337, 310/357–359, 367–369, 327, 326, 366

[56] References Cited

U.S. PATENT DOCUMENTS

| | | | |
|---|---|---|---|
| 2,540,194 | 2/1951 | Ellett | 310/359 X |
| 3,036,231 | 5/1962 | Henry | 310/367 X |
| 3,071,841 | 1/1963 | Brussaard et al. | 310/358 X |
| 3,854,060 | 12/1974 | Cook | 310/367 X |
| 4,173,009 | 10/1979 | Toda | 310/334 X |
| 4,211,948 | 7/1980 | Smith et al. | 310/334 X |
| 4,211,949 | 7/1980 | Brisken et al. | 310/334 X |
| 4,281,550 | 8/1981 | Erikson | 310/367 X |
| 4,399,387 | 8/1983 | Kohji | 310/334 |
| 4,604,543 | 8/1986 | Umemura et al. | 310/358 X |

*Primary Examiner*—Mark O. Budd

*Attorney, Agent, or Firm*—Antonelli, Terry & Wands

[57] ABSTRACT

On the front face of a piezoelectric plate, electrodes split into an array form are disposed. Thus, there is provided a transducer of monolithic array type having an array of transducer elements operating independently, without cutting the piezoelectric plate. On the rear face of the piezoelectric plate, a plurality of grooves are formed to attenuate the Lamb wave propagating in the face direction while being reflected at the front face and the rear face.

18 Claims, 11 Drawing Figures

ULTRASONIC TRANSDUCER OF MONOLITHIC ARRAY TYPE

BACKGROUND OF THE INVENTION

The present invention relates to an array ultrasonic transducer used for an ultrasonodiagnosis system, a nondestructive testing equipment, an ultrasonic therapy system, or the like.

As an ultrasonic transducer capable of electronic focusing or electronic scanning using an ultrasonic beam, an array ultrasonic transducer is known. For producing a typical ultrasonic array transducer, a piezoelectric plate, which has electrodes on both faces and which has been subjected to poling, is formed into a row of fine strip-shaped elements by dicing. Conversion between an ultrasonic wave and an electric signal is conducted by the thickness mode vibration of respective elements. However, the spatial resolution demanded by the ultrasonodiagnosis and the ultrasonic measurement has recently become higher. Thus, the required strip forming technology is approaching the limitation as described below. For attaining higher resolution, it is necessary to raise the ultrasonic frequency and the number of elements used for transmission and reception of the ultrasonic waves. In both of these cases, the width of the above described elements must be made small, resulting in a difficult problem for strip dicing.

Attempts to obtain a transducer capable of electronic scanning or electronic focusing without conducting dicing are described in Japanese Patent Unexamined Publication No. 58-156295 (1983), for example. In a transducer of this type, a large number of split electrodes are formed on the surface of the piezoelectric plate in an array form. The area of each electrode is used as a transducer element. The transducer of this type is hereafter referred to as an ultrasonic transducer of monolithic array type.

Since in the transducer of monolithic array type it is easy to reduce the width of the element to reduce the element spacing, the transducer of monolithic array type is suitable to a high frequency signal and is promising as a transducer for obtaining an image with high resolution. In the transducer of this type, however, an ultrasonic wave of one mode is propagated within the piezoelectric plate in its lengthwise direction while being reflected by the first and second faces of the piezoelectric plate, resulting in an unwanted response. Accordingly, such represent a disadvantage which may be incurred in practical use.

SUMMARY OF THE INVENTION

An object of the present invention is to provide an ultrasonic transducer which is suitable to a high frequency signal and which prevents an ultrasonic wave of unwanted mode from being generated.

Another object of the present invention is to provide such an ultrasonic transducer that even a small element spacing may be easily realized with high precision in production of the transducer and photographing with high resolution may be easily conducted.

In accordance with a feature of the present invention, there is provided an ultrasonic transducer including a piezoelectric plate having a first face which is flat and having a second face which is provided with a plurality of grooves, and including electrodes formed in array by splitting the first face of the piezoelectric plate into a plurality of areas so that each area of the piezoelectric plate may operate in the thickness vibration mode as an independent transducer element, the first face being used for transmitting and receiving the ultrasonic wave. Owing to such a structure, an ultrasonic wave (a Lamb wave) of such a mode that the wave is propagated in the lateral direction within the piezoelectric plate while being reflected is scattered and attenuated more significantly when it is reflected at the second face. Accordingly, the unwanted response caused by some components of the Lamb wave emitted into the object media is reduced to a degree offering no problem by the grooves.

Further, in the above described structure, the precision of the array of transducer elements is not defined by the work precision of the above described grooves, but defined by the precision with which the split electrodes are formed. It is thus possible to easily realize an array transducer having high resolution which is arranged with a fine width for high frequency application.

DESCRIPTION OF THE PREFERRED EMBODIMENT

Figure 1:
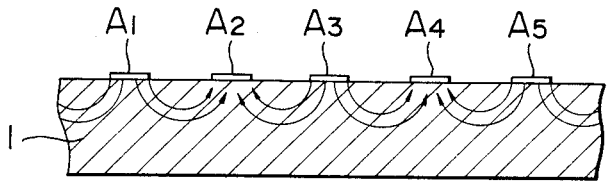
FIGS. 1 and 2 show sectional views of a conventional ultrasonic monolithic transducer.
Figure 2:
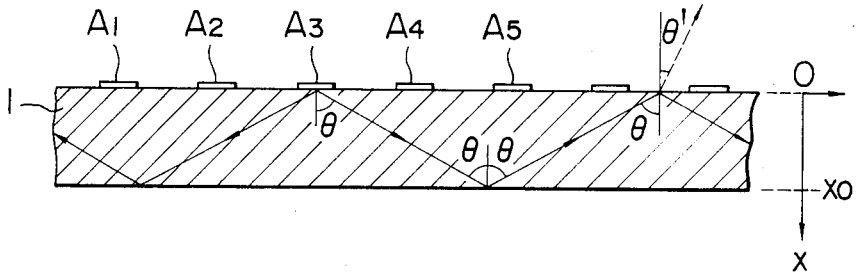

Prior to description of embodiments of the present invention, the transducer disclosed in Japanese Patent Unexamined Publication No. 58-156295 will now be described by referring to FIGS. 1 and 2. On one of the faces of a piezoelectric plate 1 of this transducer, a plurality of stripe electrodes $A_1$ to $A_5$ so split that they may be independently driven are disposed. The polarity of polarization directly under a stripe electrode is opposite to that of polarization directly under the neighboring stripe electrode. Thus, the transducer has a sectional structure as schematically illustrated in FIG. 1. Arrows in FIG. 1 represent electric field lines in poling. More particularly, an electrode C (not illustrated) is uniformly added on the other face opposite to the face having electrodes A thereon in the piezoelectric plate 1.

Assuming that one of the stripe electrodes, say $A_3$, of the conventional monolithic transducer is driven, strain is caused around the hot electrode by piezoelectricity. Some component of the strain excites an ultrasonic wave (a Lamb wave) of such a mode that the wave is propagated in the lengthwise direction of the piezoelectric plate while being repetitively reflected as represented by arrows in FIG. 2. The angle $\theta$ of reflection in propagation can be related to the ultrasound frequency f, the sound velocity $V_p$ of the piezoelectric plate, the thickness $X_o$ of the plate, and the number n of nodes of strain distribution between reflection points as $$\cos\theta = \frac{2}{n+1} \cdot \frac{5X_o}{V_p} \quad (n = 0,1,2\ldots) \tag{1}$$

Some components of the Lamb wave is emitted into the object media as an ultrasonic wave oriented at an angle $\theta'$ as represented by equation (2) below. This component might cause an unwanted response of the ultrasonic transducer, resulting in a difficult problem in practical use.

$$\sin\theta' = \frac{U_m}{V_p}\sin\theta \quad (2)$$

Figure 3A:
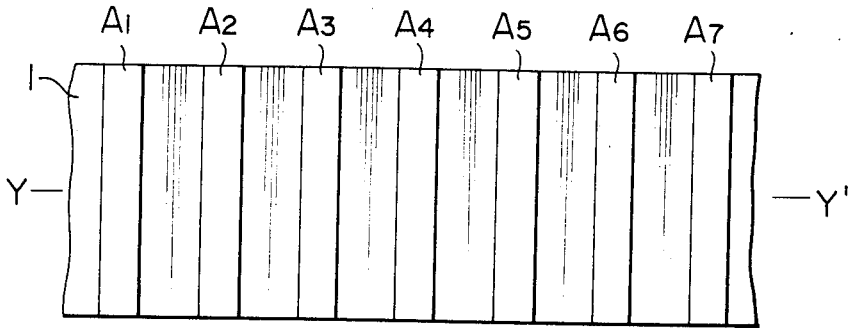
FIG. 3 shows a top view, a side view, and a bottom view of an embodiment of the present invention.
Figure 3B:
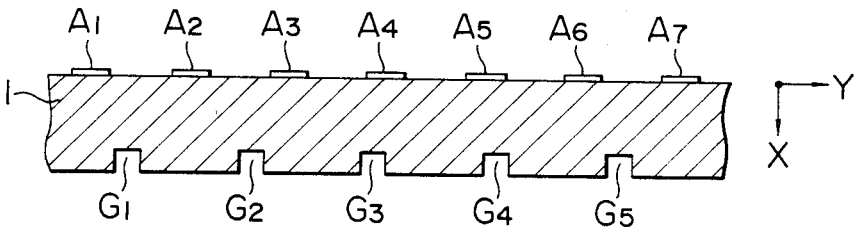
Figure 3C:
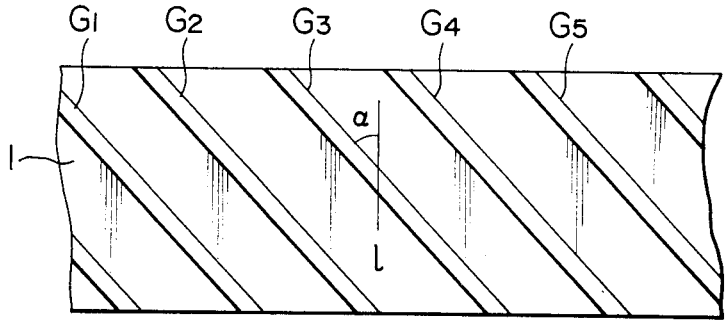

An embodiment of the present invention is illustrated in FIG. 3. FIG. 3A shows a piezoelectric plate used in the transducer of the present invention seen from the object media side. FIG. 3B shows the sectional view of the piezoelectric plate seen along a line Y–Y'. FIG. 3C shows the piezoelectric plate seen in a direction opposite to that of FIG. 3A. On the front face of the piezoelectric plate 1, electrodes $A_1$ to $A_n$ split into an array are formed. Grooves $G_1$ to $G_5$ are formed on the rear face. A line l of FIG. 3C indicates the direction of the lines obtained by projecting boundaries between the electrodes $A_1$ to $A_7$ onto the rear face. The grooves $G_1$ to $G_5$ are formed in a direction crossing the line l at a predetermined angle $\alpha$. In accordance with a typical structure of the transducer of monolithic array type using the piezoelectric plate of FIG. 3, the piezoelectric plate 1 has undergone poling uniformly in the thickness direction beforehand and a ground electrode (not illustrated) is disposed on the bottom face of the piezoelectric plate. In this transducer, transmission and reception of signals are carried out individually by using the electrodes $A_1$ to $A_n$ respectively. Thus, each electrode portion operates as an individual transducer element. The ultrasonic wave of such a mode as to be propagated in the Y axis direction while being reflected is attenuated by the grooves $G_1$ to $G_5$. Since the grooves G1 to G5 are disposed in a direction different from that of the electrodes $A_1$ to $A_5$, the above described unwanted ultrasonic wave is largely attenuated. The electrodes $A_1$ to $A_7$ can be easily formed with high precision by means of evaporation with a mask. Accordingly, a transducer having fine element spacing can be easily obtained with high precision. Since the spacing of the grooves $G_1$ to $G_5$ may be wider than that of the electrodes $A_1$ to $A_7$, especially high work precision is not demanded for formation of the grooves.

Figure 4:
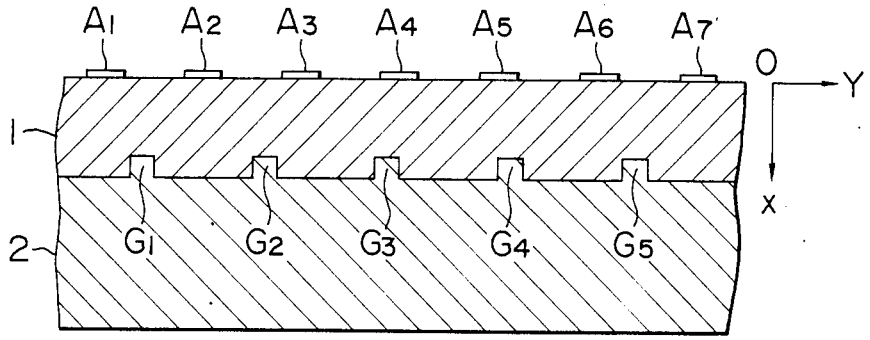
FIGS. 4 and 5 show sectional views of other embodiments of the present invention, respectively.

FIG. 4 shows the sectional view of another embodiment of a transducer formed by using the piezoelectric plate of FIG. 3. In this embodiment, a layer 2 composed of a sound absorption material is laminated on the rear face of the piezoelectric plate 1, and this sound absorption material is filled in the grooves $G_1$ to $G_5$. Owing to this contrivance, the ultrasonic wave (a Lamb wave) of the mode propagating in the illustrated y-axis direction and causing an unwanted response of the transducer is further decreased, resulting in an enhanced effect of the present invention.

Figure 5:
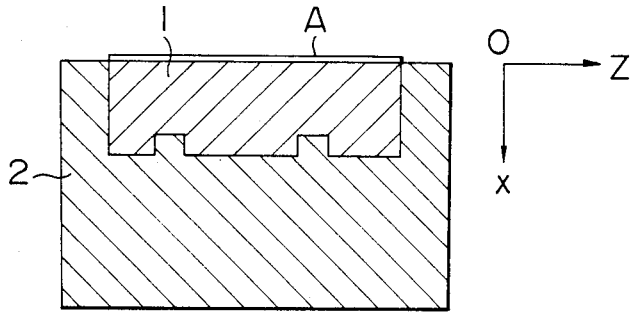

FIG. 5 shows the sectional view of still another embodiment of a transducer using the piezoelectric plate of FIG. 3, seen in the xz plane direction. The structure of FIG. 5 is characterised in that the sound absorption material 2 is in contact with not only the rear face of the piezoelectric plate 1 but also the side faces thereof. Owing to the sound absorption material, an ultrasonic wave scattered by the grooves as illustrated in FIG. 3C so as to have a velocity vector component in the z axis direction is absorbed. As a result, the ultrasonic wave of the mode causing the unwanted response of the transducer is further attenuated.

Figure 6:
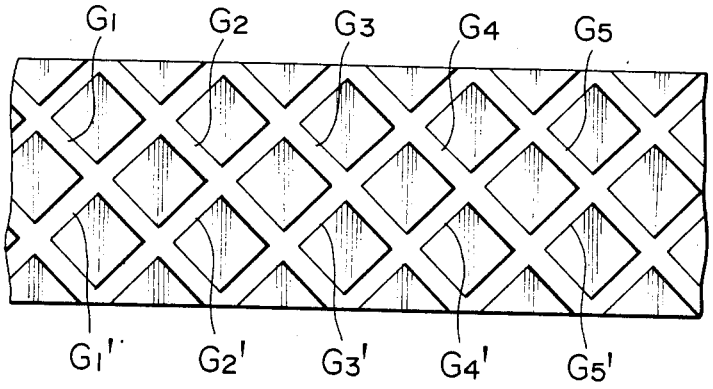
FIG. 6 shows a bottom view of still another embodiment of the present invention.

FIG. 6 shows the rear face of still another embodiment of a piezoelectric plate. In this embodiment, not only grooves ($G_1$ to $G_5$ etc.) running in one direction but also grooves ($G_1'$ to $G_5'$ etc.) running in another direction and crossing the above described grooves are formed on the rear face of the piezoelectric plate. In this structure, the Lamb wave is scattered more significantly as compared with the structure of FIG. 3A, the effect of the present invention being enhanced.

Figure 7:
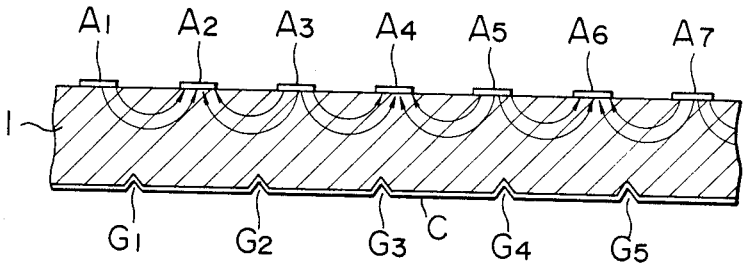
FIGS. 7, 8 and 9 show sectional views of still other embodiments of the present invention.
Figure 8:
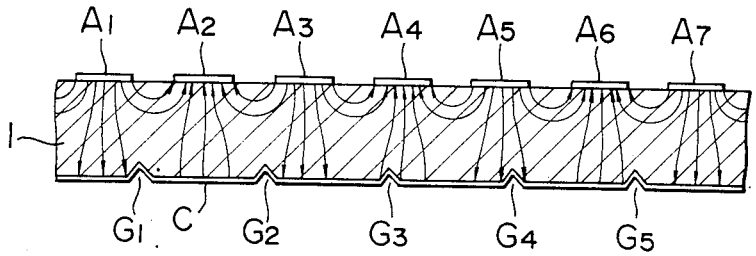
Figure 9:
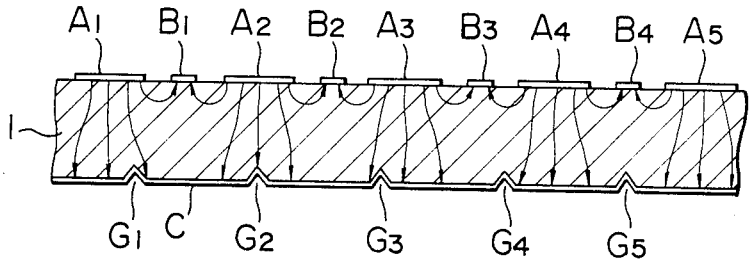

FIGS. 7 to 9 show embodiments of a transducer using a piezoelectric plate which is different from the piezoelectric plate of FIG. 3 in the poling method illustrated in FIG. 3.

In the embodiment represented by the sectional view of FIG. 7, grooves $G_1$ to $G_5$ are formed on the rear face of a piezoelectric plate which has not undergone poling, and electrodes $A_1$ to $A_7$ split into array are formed on the front face of the piezoelectric plate. Subsequently, even-numbered electrodes among the electrodes $A_1$ to $A_7$ are connected together to a positive voltage source and odd-numbered electrodes are connected together to a negative voltage source to effect poling. Arrows of FIG. 7 represent electric field lines in poling. This poling produces a structure in which the direction of polarization in an area beneath a stripe electrode is opposite to that in the area beneath its neighboring stripe electrode and the strength of polarization is increased as the electrode approaches the front face of the piezoelectric plate. Subsequently, a ground electrode C is formed on the rear face of the piezoelectric plate. In this embodiment, the grooves $G_1$ to $G_5$ are so formed as to have V shapes in the sectional views so that the uniform ground electrode C may be easily attached by evaporation, for example.

In an embodiment illustrated in FIG. 8, the ground electrode C is formed prior to poling and the electrodes $A_1$ to $A_7$ are alternately connected to the positive power source and the negative power source. With the ground electrode C coupled to the ground potential, an electric field is applied between the electrodes $A_1$ to $A_7$ and the ground electrode C confronting them as well to effect poling. Arrows in FIG. 8 represent electric field lines. In both of transducers of FIGS. 7 and 8, an unwanted ultrasonic wave propagated in the z direction is attenuated by the grooves $G_1$ to $G_5$ in the same way as the transducer having the piezoelectric plate of FIG. 3. In addition, the embodiment of FIG. 7 has advantageously an excellent impulse response. The embodiment of FIG. 8 is higher than that of FIG. 7 in transmitting and receiving sensitivity.

In the embodiment of FIG. 9, fine linear electrodes $B_1$ to $B_4$ are disposed in gaps between the electrodes $A_1$ to $A_5$ separately formed on the front face of the piezoelectric plate 1. In the same way as FIGS. 7 and 8, the grooves $G_1$ to $G_5$ and the uniform ground electrode C are formed on the rear face of the piezoelectric plate 1. Poling is conducted by connecting the electrodes $A_1$ to $A_5$ to the positive power source and connecting the electrodes $B_1$ to $B_4$ and C to the negative power source. Arrows in FIG. 9 represent electric field lines at that time. When the piezoelectric plate is used for a transducer, all of the electrodes C and $B_1$ to $B_4$ are used as the ground electrode, and respective signals are applied to the electrodes $A_1$ to $A_5$. In the embodiments of FIGS. 7 and 8, the polarity of the signal transmitted and received in a transducer element must be inverted with respect to that in its neighboring transducer element. Meanwhile, signals of all transducer elements can be advantageously used with the same polarity in the embodiment of FIG. 9. The embodiment of FIG. 9 have an advantage over the structure using the piezoelectric plate of FIG. 3, because crosstalk caused by electrical coupling between elements is reduced even if the spacing between stripe electrodes associated with transducer elements is made narrower. In the embodiments of FIGS. 7 to 9 as well, it is possible to further attenuate the unwanted ultrasonic wave propagating in the Y axis direction by using the sound absorption material 2 illustrated in FIG. 4 or 5 together.

What is claimed is:

1. An ultrasonic transducer cmprising:

a piezoelectric plate having a first face which is flat and having a second face opposite to said first face which is provided with a plurality of grooves; and electrodes formed in array by splitting said first face of said piezoelectric plate into a plurality of areas so that each area of said piezoelectric plate may operate as an independent transducer element, said first face having said electrodes of array form disposed thereon being used for transmitting and receiving the ultrasonic wave.

2. An ultrasonic transducer according to claim 1, further comprising a sound absorption material filled in said plurality of grooves.

3. An ultrasonic transducer comprising:

a piezoelectric plate having a first face which is flat and having a second face which is provided with a plurality of grooves; and electrodes formed in array by splitting said first face of said piezoelectric plate into a plurality of areas so that each area of said piezoelectric plate may operate as an independent transducer element, said first face being used for transmitting and receiving the ultrasonic wave, said plurality of grooves being disposed in at least one direction different from that of the boundary splitting said electrodes of array form.

4. An ultrasonic transducer comprising:

a piezoelectric plate having a first face which is flat and having a second face which is provided with a plurality of grooves; and electrodes formed in array by splitting said first face of said piezoelectric plate into a plurality of areas so that each area of said piezoelectric plate may operate as an independent transducer element, said first face being used for transmitting and receiving the ultrasonic wave, said plurality of grooves being disposed in a plurality of directions different from that of the boundary splitting said electrodes of array form.

5. An ultrasonic transducer according to claim 3, further comprising a layer of sound absorption material formed on the side face of said piezoelectric plate.

6. An ultrasonic transducer according to claim 4, further comprising a layer of sound absorption material formed on the side face of said piezoelectric plate.

7. An ultrasonic transducer according to claim 1, further comprising a ground electrode formed on said second face of said piezoelectric plate.

8. An ultrasonic transducer according to claim 7, wherein said piezoelectric plate is polarized uniformly in a direction perpendicular to said first and second faces.

9. An ultrasonic transducer according to claim 7, wherein said piezoelectric plate is polarized so that the direction of polarization in an area beneath one of said split electrodes is opposite to that in an area beneath an adjacent one of said split electrodes.

10. An ultrasonic transducer according to claim 7, wherein a linear electrode is disposed in each gap between areas of said electrodes of array form disposed on said first face.

11. An ultrasonic transducer according to claim 10, wherein the direction of polarization on the areas having said electrodes of array form disposed thereon is opposite to that of the areas having said linear electrodes disposed thereon.

12. An ultrasonic transducer according to claim 3, wherein said plurality of grooves are disposed in a single direction different from that of the boundary splitting said electrodes of array form.

13. An ultrasonic transducer according to claim 3, further comprising a sound absorption material filled in said plurality of grooves.

14. An ultrasonic transducer according to claim 3, further comprising a ground electrode formed on said second face of said piezoelectric plate.

15. An ultrasonic transducer according to claim 14, wherein said piezoelectric plate is polarized uniformly in a direction perpendicular to said first and second faces.

16. An ultrasonic transducer according to claim 14, wherein said piezoelectric plate is polarized so that the direction of polarization in an area beneath one of said split electrodes is opposite to that in an area beneath an adjacent one of said split electrodes.

17. An ultrasonic transducer according to claim 14, wherein a linear electrode is disposed in each gap between areas of said electrodes of array form disposed on said first face.

18. An ultrasonic transducer according to claim 17, wherein the direction of polarization on the areas having said electrodes of array form disposed thereon is opposite to that of the areas having said linear electrodes disposed thereon.

* * * * *